US008994638B2

(12) United States Patent
Zhang

(10) Patent No.: US 8,994,638 B2
(45) Date of Patent: Mar. 31, 2015

(54) BACKLIGHT SCANNING METHOD AND LIQUID CRYSTAL DISPLAY

(75) Inventor: Lilei Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 113 days.

(21) Appl. No.: 13/488,710

(22) Filed: Jun. 5, 2012

(65) Prior Publication Data

US 2012/0313846 A1 Dec. 13, 2012

(30) Foreign Application Priority Data

Jun. 9, 2011 (CN) ..... 2011 1 0154301

(51) Int. Cl.
*G09G 3/36* (2006.01)
*G09G 3/34* (2006.01)

(52) U.S. Cl.
CPC ..... *G09G 3/342* (2013.01); *G09G 3/3611* (2013.01); *G09G 2310/0237* (2013.01); *G09G 2310/024* (2013.01); *G09G 2320/0261* (2013.01)
USPC ..... 345/102; 345/690

(58) Field of Classification Search
USPC ..... 345/102, 690
See application file for complete search history.

(56) References Cited

U.S. PATENT DOCUMENTS

| | | | | |
|---|---|---|---|---|
| 2006/0125774 | A1 | 6/2006 | Nishigaki | |
| 2011/0096101 | A1 * | 4/2011 | Lee et al. | 345/690 |
| 2011/0134158 | A1 * | 6/2011 | Onishi | 345/690 |
| 2012/0075286 | A1 * | 3/2012 | Shim et al. | 345/419 |

FOREIGN PATENT DOCUMENTS

| | | | |
|---|---|---|---|
| CN | 1791298 A | | 6/2006 |
| CN | 101749668 A | * | 6/2010 |
| CN | 101826296 A | | 9/2010 |
| JP | 2007-171480 A | | 7/2007 |

OTHER PUBLICATIONS

First Chinese Office Action dated; May 6, 2013; Appln. No. 201110154301.6.

* cited by examiner

*Primary Examiner* — Amare Mengistu
*Assistant Examiner* — Jennifer Zubajlo
(74) *Attorney, Agent, or Firm* — Ladas & Parry LLP

(57) ABSTRACT

The disclosed technology discloses a backlight scanning method for controlling a backlight of a liquid crystal display panel, the backlight comprising light groups on left and right sides. The method comprises steps of: determining a time period for turning on and off the light groups on the left and right sides in accordance with a control signal for pixels in the liquid crystal display panel; and in scanning, turning on and off the light groups on the left and right sides alternately in sets, and during the course of scanning one frame, turning on or off the light groups on the left and right sides at least two times.

8 Claims, 4 Drawing Sheets

BACKLIGHT SCANNING METHOD AND LIQUID CRYSTAL DISPLAY

BACKGROUND

One or more embodiments of the disclosed technology relate to a backlight scanning method for a liquid crystal display and a liquid crystal display.

Liquid crystal displays (LCDs) suffer from two main shortcomings in application to televisions: severe motion artifacts (which occur when displaying moving scenes or an action movie) and inadequate contrast (in a dark field condition). A black frame insertion technology is a common technology for shortening a response time. A fast pulse modulation effect similar to that in cathode ray tube (CRT) display can be produced by interpolating a black frame for every image frame. A flickering light-emitting diode (LED) backlight can also produce an effect similar to the insertion of a black frame, and it achieves the black frame insertion effect by regularly turning off the backlight. Furthermore, a good effect can also be obtained by a backlight scanning method for driving the backlight in a pulse modulation manner. One of current trends is to combine these fast response technologies so as to attain a shorter gray-to-gray response time.

FIG. 1 shows a schematic view showing the principle of improving a motion smear (streaking) by backlight blinking and backlight scanning, where an LED backlight is turned on or off at a proper place of a liquid crystal response curve. The backlight is turned off when the liquid crystal response curve is in a slow ascending phase or a descending phase (a tailing phase), and is turned on when the liquid crystal response curve is in a stable phase. To realize a backlight source employing a backlight scanning technology and also ensure lightness and thinness, a side-light type backlight scanning technology has become a hot research concern. A difficulty in application of the side-light type backlight scanning technology lies in that it is necessary to assure that the light in a region radiated by an LED group will not diffuse into other regions and ensure that a corresponding LED group is turned on in the stable response phase of liquid crystals in pixels. It is important to ensure that a corresponding LED group is in an off-state in the stable response phase of liquid crystals in pixels, so that pixels not in the stable response phase are imperceptible by human eyes.

SUMMARY

Embodiments of the disclosed technology provide a backlight scanning method and a liquid crystal display capable of performing a backlight scanning by light bars on the left and right sides, to thereby improve the display effect.

According to an embodiment of the disclosed technology, there is provided a backlight scanning method for controlling a backlight for a liquid crystal display panel, the backlight comprising light groups on left and right sides, the method comprising steps of: determining a time period for turning on and off the light groups on the left and right sides in accordance with a control signal for pixels in the liquid crystal display panel; and in scanning, turning on and off the light groups on the left and right sides alternately in sets, and during the course of displaying one frame by the liquid crystal display, turning on or off the light groups on the left and right sides at least two times.

According to another embodiment of the disclosed technology, there is provided a liquid crystal display comprising: a liquid crystal display panel, a backlight, a backlight control unit, and a pixel control unit. The backlight comprises light groups on left and right sides, and each of the light groups on the left and right sides are connected to the backlight control unit which is connected to the pixel control unit; the pixel control unit is adapted to provide a control signal for liquid crystal response in pixels of the liquid crystal display panel to the backlight control unit; and the backlight control unit is adapted to determine a time period for turning on and off the light groups on the left and right sides in accordance with the received control signal, and to turn on and off the light groups on the left and right sides alternately in sets. During the course of displaying one frame by the liquid crystal display panel, the light groups on the left and right sides are controlled to be turned on or off at least two times.

Further scope of applicability of the disclosed technology will become apparent from the detailed description given hereinafter. However, it should be understood that the detailed description and specific examples, while indicating preferred embodiments of the disclosed technology, are given by way of illustration only, since various changes and modifications within the spirit and scope of the disclosed technology will become apparent to those skilled in the art from the following detailed description.

BRIEF DESCRIPTION OF THE DRAWINGS

The disclosed technology will become more fully understood from the detailed description given hereinafter and the accompanying drawings which are given by way of illustration only, and thus are not limitative of the disclosed technology and wherein.

DETAILED DESCRIPTION

Figure 1:
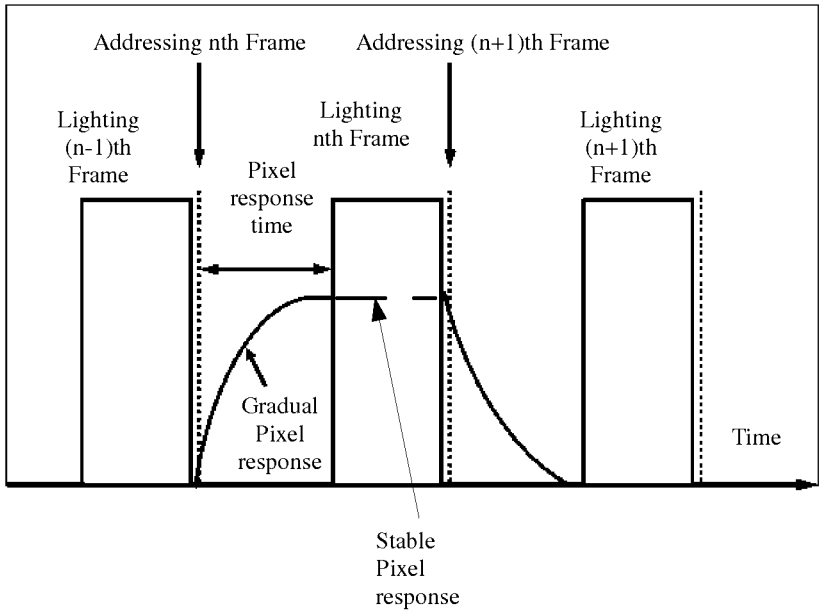
(PRIOR ART) Fig.1
FIG. 1 is a schematic view showing the principle of improving a motion smear by blinking backlights and scanning backlights in a conventional technology.
Figure 2:
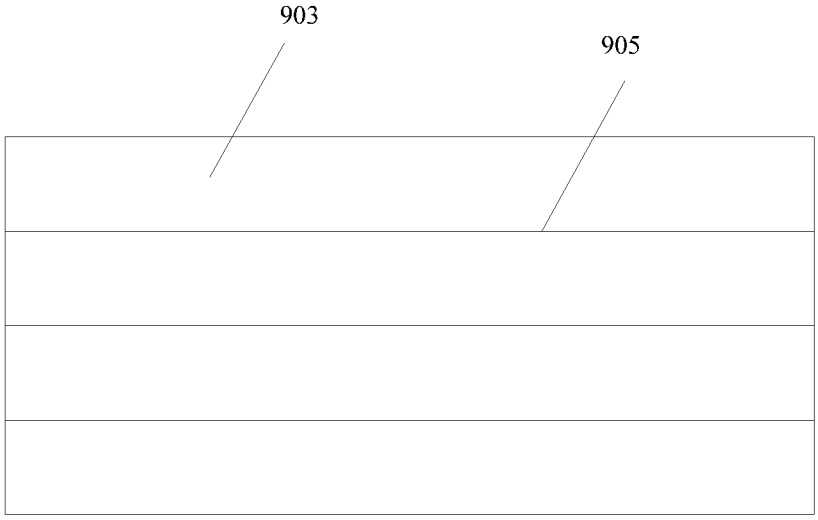
(PRIOR ART) Fig.2
FIG. 2 is a schematic view showing the joints of light guide plates in the conventional technology.

In the side-light type backlight scanning technology, the light emitted from the backlight scanning will be processed by light guide plates 903. There will occur shadow portions at junction sites 905 among the light guide plates 903, as shown in FIG. 2. A common method for solving the shadow problem due to the joint between the light guide plates 903 is providing a light mixing element or increasing a light mixing distance. The inventors have found that two adjacent light guide plates 903 have quite high luminance with slightly low luminance therebetween and give rise to strong contrast. Even though the shadow portions at the joints of the light guide plates 903 are very narrow, it will still be perceptible by human eyes if it is not processed, which will adversely affect the display performance.

According to an embodiment of the disclosed technology, a plurality of light sources (e.g., light groups or LED groups)

on the left and right sides of a backlight module with a row interval (i.e., arranged along the direction perpendicular to the pixel row direction with an interval) are turned on or off simultaneously, i.e., two adjacent sets (which are adjacent in the direction perpendicular to the pixel row direction) are not turned on or off simultaneously, thereby increasing a distance between lighting areas. A light distribution becomes more uniform with light guide plates 903. Therefore, the problem that the display effect is adversely affected by a strong contrast between joints of the light guide plates 903 and the surrounding can be solved. Furthermore, in the conventional technology, all the light sources on both the left and right sides are always turned on simultaneously during the course of a whole frame scanning, so that shadow portions at the joints of the light guide plates 903 stay for relatively long time period and is more easily perceptible by human eyes, adversely affecting display performance. In contrast, during the course of one frame scanning according to the embodiment of the disclosed technology, light sources on both the left and right sides are turned on or off at least twice so that a turn-off time of the light groups of the backlight in one frame is shortened and the contrast between light portions and dark portions can reduced, improving display performance.

A flow of a backlight scanning method according to the embodiment is as follows:

The backlight scanning method according to the embodiment is adapted to control a backlight for a liquid crystal display panel, the backlight comprising light sources (e.g., light groups or LED groups) on both the left and right sides. Here, light groups are taken for example for description, and each light group may comprise at least one light.

In step 301, a time period for turning on and off the light groups on the left and right sides is determined in accordance with a control signal for pixels in the liquid crystal display panel.

In step 302, in scanning, the light groups on the left and right sides are turned on and off alternately in sets, and during the course of displaying one frame of picture by the liquid crystal display, the light groups on the left and right sides are turned on or off at least two times.

Figure 3:
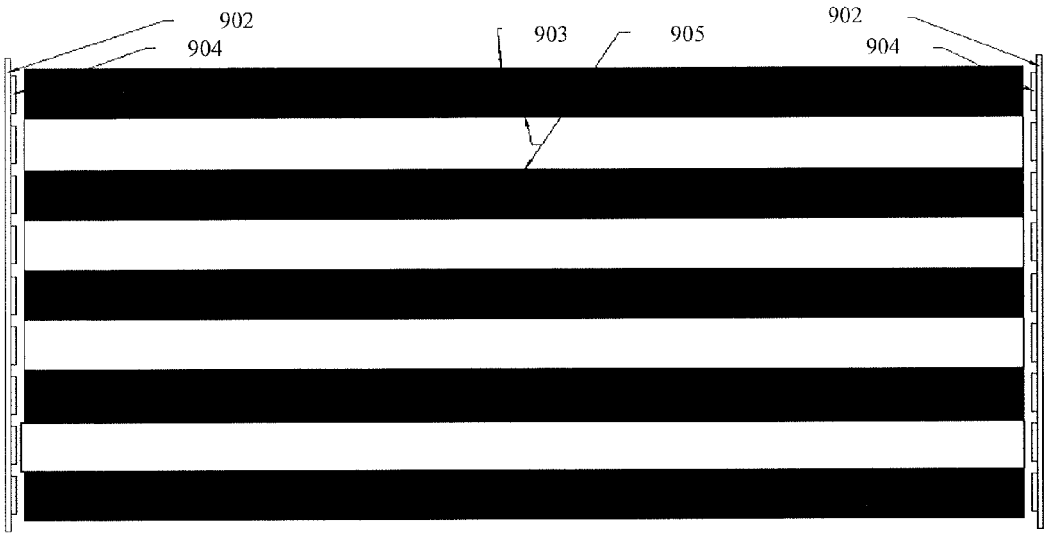
FIG. 3 is a schematic view showing light groups on the left and right sides are turned on and off alternately in sets according to an embodiment of the disclosed technology.
Figure 4:
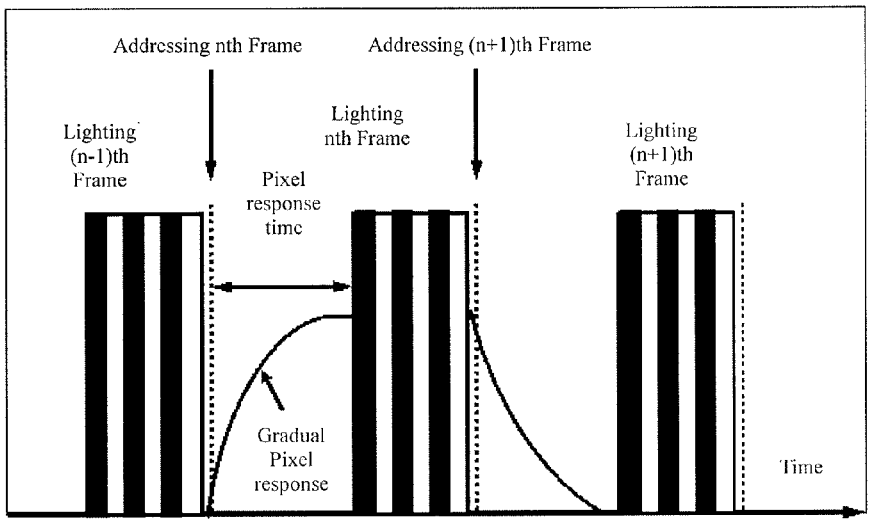
FIG. 4 is a schematic view showing a turn-on and -off time period of a light group within one frame scanning according to an embodiment of the disclosed technology.

In the embodiment, the light groups on the left and right sides are turned on and off alternately in sets, as shown in FIG. 3, the contrast between joints of light guide plates and the surroundings can be reduced, thereby improving the display effect. Furthermore, the light groups on the left and right sides are turned on or off more than one time during the stable phase of pixel response (liquid crystal response), so that the time period during which the relatively darker sites or portions of the display affects human eyes can be shortened, thereby improving display effect. As shown in FIG. 4, for the light groups on both the left and right sides in a corresponding row, they are turned off when the pixel response starts to become stable (i.e., the shadow area in the first column on the left in FIG. 4), turned on as time goes by (i.e., the white area in the first column on the left in FIG. 4), and then turned off and turned on once more. Preferably, during the course of scanning one frame, the light groups on the left and right sides are turned on and off at least three times. The light groups on the left and right sides being turned on and off alternately in sets may be implemented by dividing the light groups both the left and right sides into two set kinds arranged in an interlace manner (e.g., odd sets and even sets) and turning off and on alternately the light groups of the two set kinds. Each set may comprise at least one light group.

If the light groups on the left and right sides are turned on or off at least two times during the course of scanning one frame, the light groups on the left and right sides of a panel for the whole pixel region may comprise at least three sets; correspondingly, the pixel rows of the whole pixel region can be divided into at least three sets, and each pixel set may comprise at least one row of pixels. In the embodiment, the three pixel sets may have the same size or different sizes. In one example, preferably the three pixel sets have substantially the same size. Because the number of rows in the whole pixel region is not necessarily the times of 3, it may be possible for the three sets to have an identical size. 'Substantially the same' means that the difference among the number of pixel rows of the three pixel sets is not more than one row in the embodiment.

Specifically, at each time that one set of light groups is scanned, the light group of the scanned set and other light groups in synchronization with the light group (in the same set kind) are turned on, and meanwhile the asynchronous light groups with respect to the light group (in a different set kind) are turned off. In the embodiment, the light groups on the left and right sides are divided into two set kinds in advance, and the set(s) of light groups in a first partial area corresponding to the first set kind, and the set(s) of light groups in a second partial area corresponding to the second set kind are arranged alternately. The light groups corresponding to the scanned set and other light groups of the set(s) belonging to the same partial area are turned on, and meanwhile the light groups in another partial area are turned off. That is, the light groups on the left and right sides belonging to the same partial area will be turned on or off synchronously, and the light groups on the left and right sides belonging to different partial areas will be turned on or off asynchronously. For instance, when the light groups on the left and right sides in the first partial area are turned on, the light groups on the left and right sides in the second partial area are turned off; when the light groups on the left and right sides in the second partial area are turned on, the light groups on the left and right sides in the first partial area is turned off. As shown in FIG. 3, the light groups on the left and right sides corresponding to black areas belong to the first partial area, and the light groups on the left and right sides corresponding to white areas belong to the second partial area.

Figure 5:
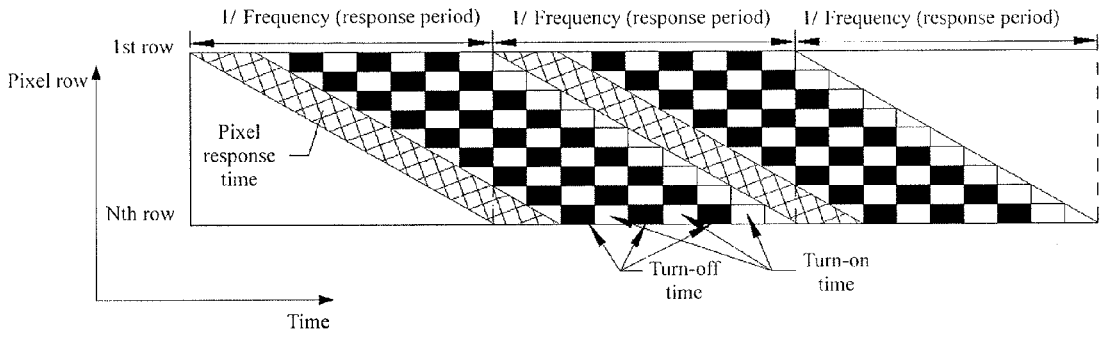
FIGS. 5 and 6 are schematic views showing a turn-on and -off time period of light groups and pixel rows according to an embodiment of the disclosed technology.

Preferably, when pixels in the last row in a scanned set start to respond stably (i.e., in a stable phase), the light groups corresponding to the set and other light groups belonging to the set(s) of the same partial area are turned on, and meanwhile light groups in another partial area are turned off, so as to further improve the display effect. As shown in FIG. 5, the whole pixel region (from the first row to the nth row of pixels) is divided into 9 sets for example, and when pixels in the last row in the first set start to respond stably, the light groups on the left and right sides corresponding to the first set and the light groups on the left and right sides corresponding to other sets in the first partial area, which comprise the light groups on the left and right sides corresponding to the third set, the light groups on the left and right sides corresponding to the fifth set, the light groups on the left and right sides corresponding to the seventh set, and the light groups on the left and right sides corresponding to the ninth set, are turned off. At the same time, the light groups on the left and right sides of the sets corresponding to the second partial area, which comprise the light groups on the left and right sides corresponding to the second set, the light groups on the left and right sides corresponding to the fourth set, the light groups on the left and right sides corresponding to the sixth set, and the light groups on the left and right sides corresponding to the eighth set, are turned on. When pixels in the last row in the second set start to respond stably, the light groups on the left and right sides corresponding to the second set and the light groups on the left and right sides corresponding to other sets in the second partial area, are turned off; meanwhile, the light groups on the left and right sides of the sets corresponding to the first partial area are turned on. The operation is performed by the same way until the scanning of one frame ends, and the pixel response starts to change gradually.

Figure 6:
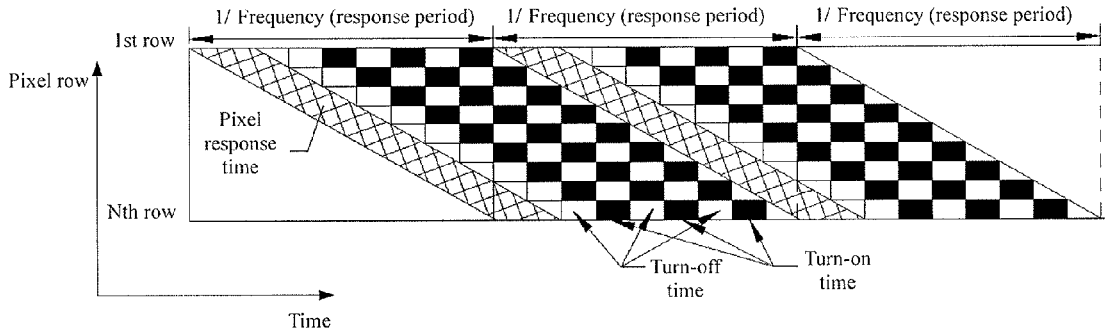

In another example, as shown in FIG. 6, when pixels in the last row in the first set start to respond stably, the light groups on the left and right sides corresponding to the first set and the light groups on the left and right sides in other sets corresponding to the first partial area are turned on; meanwhile, the light groups on the left and right sides corresponding to the second partial area are turned off. The operation is performed by the same way until the scanning of one frame ends, and the pixel response starts to change gradually.

The backlight scanning scheme in the embodiment can be applied into a liquid crystal display (LCD). Hereinafter, a structure and function of the liquid crystal display will be described.

Figure 7:
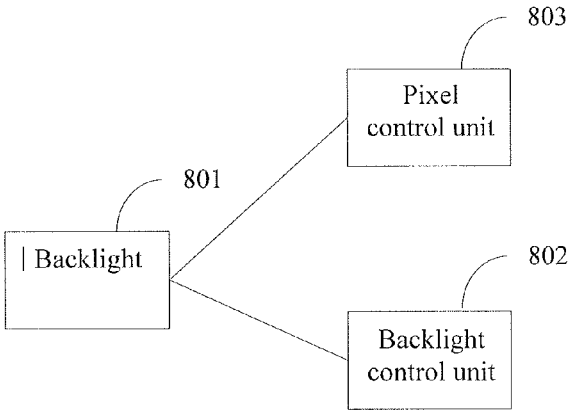
FIG. 7 is a structural view showing a liquid crystal display according to an embodiment of the disclosed technology.

As shown in FIG. 7, the liquid crystal display in the embodiment comprises: a panel, a backlight 801, a backlight control unit 802 and a pixel control unit 803. The panel comprises a pixel region and a peripheral region, and the backlight 801 is typically provided behind the panel for providing it with light for display. The liquid crystal display in the embodiment can be applied into various applications or devices, such as liquid crystal television, computer monitor, cell phone, and so on. The backlight control unit 802 and the pixel control unit 803 each can be implemented by software, hardware, firmware, or any combination thereof.

The backlight 801 may comprise a light guide plate and the light groups on the left and right sides of the light guide plate, and each of the light groups is connected to the backlight control unit 802 which is connected to the pixel control unit 803.

The pixel control unit 803 is adapted to provide control signals for liquid crystal response in pixels of the liquid crystal display panel, and to provide the backlight control unit 802 with the control signals for response of liquid crystals in pixels of the liquid crystal display panel.

The backlight control unit 802 is adapted to determine a time period for turning on and off the light groups on the left and right sides of the backlight 801 in accordance with the received control signals, and to turn on and off the light groups on the left and right sides alternately in sets. During the course of displaying one frame by the liquid crystal display panel, the light groups on the left and right sides of the backlight 801 are controlled to be turned on or off at least two times.

Specifically, at each time when the pixel control unit 803 scans a set of pixels (also the corresponding light group set), the backlight control unit 802 turns on a light group (or light groups) corresponding to the scanned set pixels and other light groups belonging to the set(s) of the same partial area, and meanwhile turns off light groups in another partial area. Preferably, the backlight control unit 802 turns on, when pixels in the last row in a scanned set begin to respond stably, the light group (or light groups) corresponding to the set and other light groups belonging to the set(s) of the same partial area, and meanwhile, turns off light groups in another partial area. One pixel set comprises at least one row of pixels in the embodiment, and the whole pixel region comprises at least three pixel sets; correspondingly, the light groups can be divided into at least three sets, and one light group set corresponds at least one pixel. The three sets can have the substantially same size or different sizes.

Figure 8:
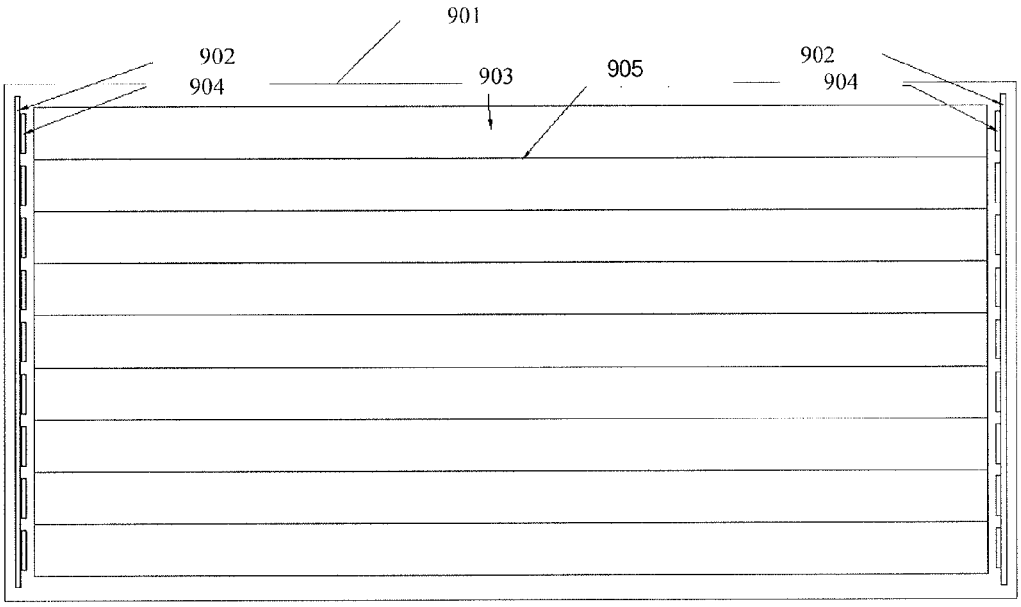
FIG. 8 is a structural view showing a backlight according to an embodiment of the disclosed technology.

As shown in FIG. 8, the backlight 801 comprises a back plate 901, light bar plates 902, light guide plates 903 and light groups 904.

The light guide plates 903 are located above the back plate 901. The light bar plates 902 are located on two sides of the back plate 901, and a plurality of light groups 904 are located on each of the light bar plates 902. Each of the light groups 904 may comprise a plurality of light emitting devices such as lights or LEDs. Herein, for example, an area covered by all of the light guide plates 903 corresponds to the pixel region.

In the embodiment of the disclosed technology, a plurality of light groups on the left and right sides are simultaneously turned on or off alternately in sets, i.e., two adjacent sets (which are adjacent in the direction perpendicular to the pixel row) are not turned on or off simultaneously, thereby increasing a distance between lighting areas. The light distribution becomes uniform with the light guide plates 903. Therefore, the problem that the display effect is adversely affected by the strong contrast between joints of the light guide plates 903 and surroundings can be solved. Furthermore, light groups on the left and right sides are always turned on during the course of scanning one whole frame in the conventional technology, so that shadow portions at the joints of the light guide plates 903 stay relatively long and are more easily perceptible by human eyes, thereby adversely affecting the display effect. While during the course of scanning one frame in the embodiment of the disclosed technology, light groups on the left and right sides are turned on or off at least two times so that the turn-off time period of the backlight in one frame can be shortened and the contrast between light portions and dark portions can reduced, improving display performance.

It should be understood by those skilled in the art that, one or more embodiments of the disclosed technology can be provided as a method, a system and a computer program product. Thus, the disclosed technology can be implemented in the form of embodiments of full hardware, embodiments of full software, or embodiments of combining software and hardware. Furthermore, the disclosed technology can be implemented in the form of a computer program product which is stored on a storage medium or a plurality of storage mediums available for a computer (comprising but not limited to a disk storage device, an optical storage device and the like) containing a program code executable by the computer therein.

The embodiment of the disclosed technology being thus described, it will be obvious that the same may be varied in many ways. Such variations are not to be regarded as a departure from the spirit and scope of the disclosed technology, and all such modifications as would be obvious to those skilled in the art are intended to be comprised within the scope of the following claims.

What is claimed is:

1. A backlight scanning method for controlling a backlight for a liquid crystal display panel, the backlight comprising light groups on left and right sides, the method comprising steps of:

determining a time period for turning on and off the light groups on the left and right sides in accordance with a control signal for pixels in the liquid crystal display panel; and in scanning, turning on and off the light groups on the left and right sides alternately in sets, and during the course of displaying one frame by the liquid crystal display, turning on or off the light groups on the left and right sides at least two times, wherein at each time that one set is scanned, a light group corresponding to the scanned set and other light groups belonging to set (s) of a same partial area as the scanned set are turned on, and meanwhile the light groups in another partial area are turned off, and the sets of the light groups in these two partial areas are distributed alternately.

2. The backlight scanning method claimed as claim 1, wherein the step of turning on a light group corresponding to the scanned set and other light groups belonging to set (s) of a same partial area as the scanned set and meanwhile turning off the light groups in another partial area at each time that one set is scanned comprises:

when pixels in the last row in the scanned set start to respond stably, a light group corresponding to the set and other light groups belonging to the same partial area are turned on, and meanwhile light groups in another partial area are turned off.

3. The backlight scanning method claimed as claim 1, wherein one light group set correspond to one pixel set, and one pixel set comprises at least one row of pixels, and the whole pixel region comprises at least three pixel sets.

4. The backlight scanning method claimed as claim 3, wherein the three pixel sets have a same size.

5. A liquid crystal display comprising:

a liquid crystal display panel, a backlight, a backlight control unit, and a pixel control unit, wherein the backlight comprises light groups on left and right sides, and each of the light groups on the left and right sides are connected to the backlight control unit which is connected to the pixel control unit;

the pixel control unit is adapted to provide a control signal for liquid crystal response in pixels of the liquid crystal display panel to the backlight control unit; and the backlight control unit is adapted to determine a time period for turning on and off the light groups on the left and right sides in accordance with the received control signal, and to turn on and off the light groups on the left and right sides alternately in sets, and wherein during the course of displaying one frame by the liquid crystal display panel, the light groups on the left and right sides are controlled to be turned on or off at least two times;

wherein at each time that the pixel control unit scans one set, the backlight control unit turns on a light group corresponding to the scanned set and other light groups belonging to set (s) of a same partial area as the scanned set, and meanwhile turns off the light groups in another partial area, and the sets of the light groups in these two partial areas are distributed alternately.

6. The liquid crystal display claimed as claim 5, wherein when pixels in the last row in the scanned set start to respond stably, the backlight control unit turns on a light group corresponding to the set and other light groups belonging to the same partial area, and meanwhile turns off light groups in another partial area.

7. The liquid crystal display claimed as claim 5, wherein one light group set correspond to one pixel set of the liquid crystal display panel, and one pixel set comprises at least one row of pixels, and the whole pixel region comprises at least three pixel sets.

8. The liquid crystal display claimed as claim 7, wherein the three pixel sets have a same size.

* * * * *